US006883274B2

(12) United States Patent
Webb et al.

(10) Patent No.: US 6,883,274 B2
(45) Date of Patent: Apr. 26, 2005

(54) DEVICE AND METHOD FOR OPENING A DOOR

(75) Inventors: Fred C. Webb, Algonquin, IL (US); Gerald Drafflorn, Jr., Woodstock, IL (US)

(73) Assignee: Knaack Manufacturing Company, Crystal Lake, IL (US)

( * ) Notice: Subject to any disclaimer, the term of this patent is extended or adjusted under 35 U.S.C. 154(b) by 105 days.

(21) Appl. No.: 10/045,232

(22) Filed: Nov. 9, 2001

(65) Prior Publication Data

US 2003/0090284 A1 May 15, 2003

(51) Int. Cl.[7] ..... E05F 11/14

(52) U.S. Cl. ..... 49/293; 49/272; 49/276

(58) Field of Search ..... 49/279, 276, 277, 49/278, 263, 264, 272, 324, 328, 329, 293; 292/32, 33, 137, 157, 138, DIG. 60

(56) References Cited

U.S. PATENT DOCUMENTS

| | | | | | |
|---|---|---|---|---|---|
| 412,356 | A | * | 10/1889 | Zerfas et al. | 292/33 |
| 533,571 | A | * | 2/1895 | Tower | 49/263 |
| 839,330 | A | * | 12/1906 | Stephenson | 49/263 |
| 920,961 | A | | 5/1909 | Keil | |
| 1,015,646 | A | * | 1/1912 | Simonton | 292/104 |
| 1,545,737 | A | * | 7/1925 | Chruden | 292/138 |
| 1,611,386 | A | * | 12/1926 | Stanley | 49/263 |
| 1,793,125 | A | * | 2/1931 | O'Connor | 292/241 |
| 1,802,812 | A | * | 4/1931 | Gratz | 49/263 |
| 1,847,564 | A | | 3/1932 | Hood | |
| 2,348,955 | A | | 5/1944 | Buchanan | |
| 2,397,926 | A | | 4/1946 | Creech | |
| 2,634,970 | A | * | 4/1953 | Rosebrook | 49/344 |
| 2,777,315 | A | | 1/1957 | Burke | |
| 2,904,823 | A | | 9/1959 | Perrill | |
| 3,012,837 | A | * | 12/1961 | Morrissey | 49/276 |
| 3,330,612 | A | | 7/1967 | Masterson et al. | |
| 3,364,621 | A | * | 1/1968 | Erickson | 49/263 |
| D260,062 | S | | 8/1981 | Knaack et al. | |
| 4,288,134 | A | | 9/1981 | Knaack et al. | |
| 4,290,281 | A | | 9/1981 | Knaack et al. | |
| 4,383,721 | A | | 5/1983 | Knaack et al. | |
| 4,395,000 | A | * | 7/1983 | Deviny et al. | 244/118.3 |
| 4,911,508 | A | * | 3/1990 | Tillman | 312/319.9 |
| 4,941,695 | A | | 7/1990 | Miller | |
| 5,076,078 | A | | 12/1991 | Weger, Jr. | |
| 5,111,615 | A | * | 5/1992 | Kuhnt et al. | 49/279 |
| 5,145,087 | A | | 9/1992 | Weger, Jr. | |
| 5,235,830 | A | | 8/1993 | Benge | |
| 5,308,126 | A | | 5/1994 | Weger, Jr. et al. | |
| 5,622,416 | A | * | 4/1997 | Rainey et al. | 312/319.9 |
| 5,927,767 | A | * | 7/1999 | Smith et al. | 292/158 |
| 6,106,213 | A | * | 8/2000 | Denker | 414/411 |

OTHER PUBLICATIONS

Published International Search Report from related PCT Application No. PCT/US02/035976.

* cited by examiner

*Primary Examiner*—Gregory J. Strimbu
(74) *Attorney, Agent, or Firm*—McDonnell Boehnen Hulbert & Berghoff LLP

(57) ABSTRACT

A method and device for opening a door includes a receptacle structure. The receptacle structure is coupled to the door. The receptacle structure has a top surface and an angled guiding surface. The top surface forms an angled protrusion. The receptacle structure has a receptacle and the receptacle is formed between the top surface and the angled guiding surface. The device also includes a latching rod and a sliding assembly coupled to the latching rod. Movement of the sliding assembly causes the latching rod to contact the angled protrusion. The contact of the latching rod with the angled protrusion of the receptacle structure causes the rod to push the receptacle structure and the door to a partially open position. After contacting the angled protrusion, the latching rod navigates across the angled guiding surface of the receptacle structure, pushing the door to a further partially open position.

11 Claims, 4 Drawing Sheets

DEVICE AND METHOD FOR OPENING A DOOR

FIELD OF THE INVENTION

This present invention relates to methods and devices for opening doors. More, specifically, it relates to methods and device for partially opening doors of storage units.

BACKGROUND OF THE INVENTION

A variety of storage units are available in today's marketplace. For instance, industrial storage cabinets may be used to store tools or other devices. In another example, storage cabinets may be used in offices to store various types of office supplies.

Storage cabinets may include a single or multiple doors, which are opened to gain entry to supplies within the storage cabinet. The doors themselves may often be locked to prevent unauthorized entry into the storage cabinet. Often, workers may bring additional supplies to the cabinet. Since the worker is bringing additional supplies to the cabinet, he or she may be carrying these supplies in his or her arms. Thus, the worker may not be able to open the cabinet without placing the additional supplies aside or dropping the supplies in an attempt to open the doors. In addition, workers may need to access the inner contents of the supply cabinet but may have his or her arms full with other supplies.

Some supply cabinets include foot pedal arrangements whereby a worker, for example, may press the foot pedal, and open the door. In this case, the worker would not need to place the material they are carrying aside or may not drop the load the or she is carrying.

Often, storage units include a security feature or features to prevent unauthorized entry into the storage unit. In one example, a simple padlock may be used to prevent unauthorized entry into the cabinet. In another example, a lock may be used so that a user needs to turn a key to unlock the cabinet and gain entry.

SUMMARY OF THE INVENTION

The system and method of the present invention advantageously allows a door to be partially opened. Once the door is partially opened, the user can push the door into a fully open position.

In one example of the present invention, a method and device for opening a door includes a receptacle structure. The receptacle structure is coupled to the door. The receptacle structure may have a top surface and an angled guiding surface. The top surface may form an angled protrusion. The receptacle structure may have a receptacle and the receptacle may be formed between the top surface and the angled guiding surface. The device may also include a latching rod and a sliding assembly coupled to latching rod. Movement of the latching rod may cause the latching rod to contact the angled protrusion. The contact of the latching rod with the angled protrusion of the receptacle structure may cause the rod to push the receptacle structure and the door, and cause the latching rod to navigate across the angled guiding surface of the receptacle structure.

The foregoing and other advantages of the system and method of the present invention will be apparent from the following more particular description of preferred embodiments of the system and method as illustrated in the accompanying drawings.

BRIEF DESCRIPTION OF THE DRAWINGS

Preferred embodiments of the present inventions are described with reference to the following drawings, wherein.

DETAILED DESCRIPTION OF PREFERRED EMBODIMENTS

Figure 1:
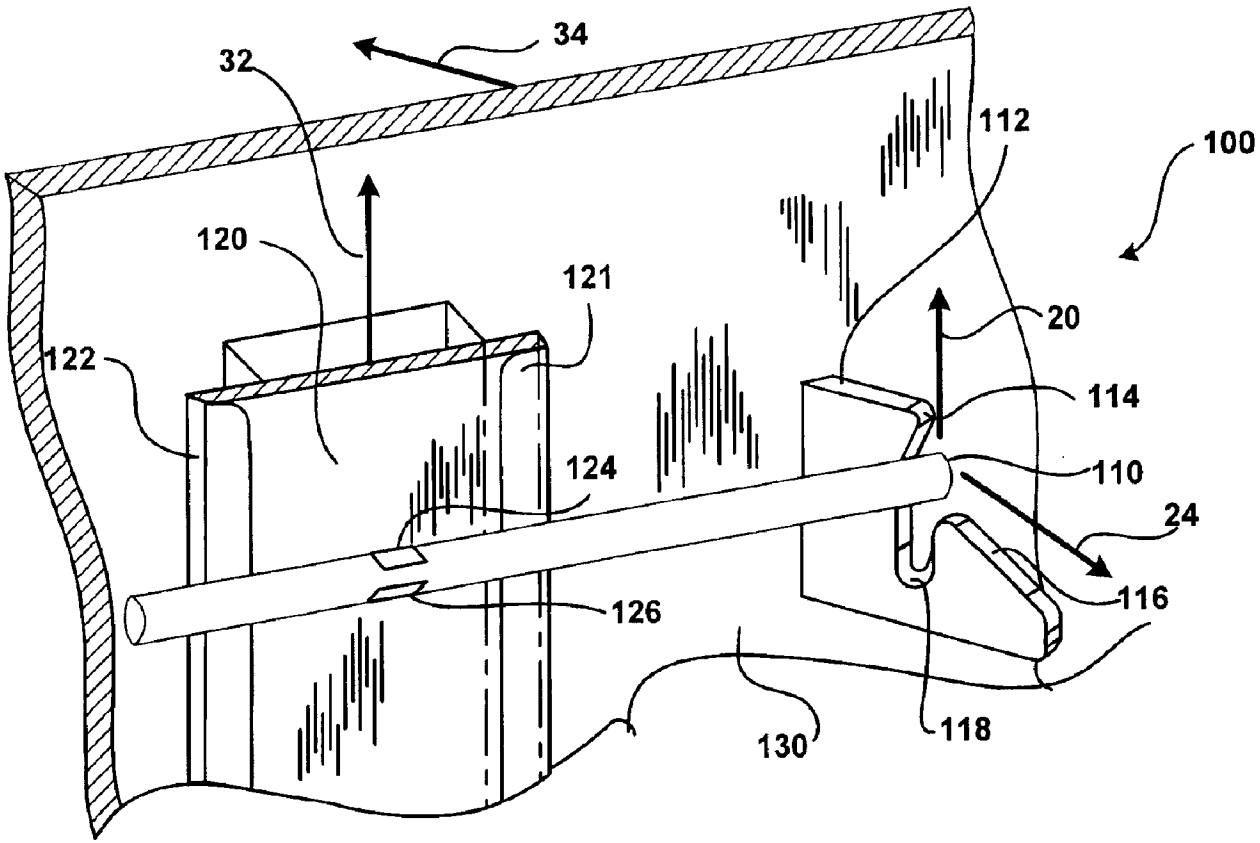
FIG. 1 is a perspective view of a device for opening a door in accordance with a preferred embodiment of the invention.

Referring now to FIG. 1, a device for opening a door includes a receptacle structure 100. The receptacle structure 100 is attached to a door 130. The receptacle structure 100 includes a top surface 112 with an angled protrusion 114. A receptacle 118 is formed in the receptacle structure 100 between the top surface 112 and an angled guiding surface 116. The receptacle structure 100 may be included in a storage unit, for example, a cabinet. Other examples of storage units are possible.

A latching rod 110 is coupled to a sliding assembly 120 via connectors 124 and 126. The sliding assembly 120 fits between guides 121 and 122.

The latching rod 10 may be composed of any suitable material, for example steel. In one example, the latching rod 110 may be one-half inch in diameter and 9 and ⅜ inches long.

The receptacle structure 100 may be formed of industrial grade steel, for example. The base may be 4.3 inches long and the structure 100 may be 3.25 inches high. As described elsewhere in this specification, the angled protrusion 114 forms an angle; with a vertical axis (not shown in FIG. 1). In one example, this angle is 30 degrees. Also as described elsewhere in this specification, the angled guiding surface 116 forms an angle with the vertical axis. In one example, this angle is 57 degrees.

In one example, the latching rod 110 (and sliding assembly 120) may be coupled to a foot pedal, which is used to move the latching rod 110 upwards, when the foot pedal is pressed. One example of such an arrangement is described elsewhere in this specification. However, the latching rod 110 (and sliding assembly 120) may be coupled to any other mechanism that moves the latching rod 110. For example, this mechanism may be activated by hand movement. Other examples are possible.

In one example of the operation of the device of FIG. 1, the latching rod 110 is moved upward in the direction of arrow 32, out of the receptacle 118 (in the direction of the arrow 20). In one example, and as described elsewhere in this specification, a foot pedal is used to lift the sliding assembly 120 (and hence, the latching rod 110).

The latching rod 110 contacts the angled protrusion 114 of the top surface and forces the assembly 100, and therefore the door 130 outward, as indicated by arrow 34. The movement of the door 130 and receptacle structure 100 together with the bumping of the latching rod 110 against the angled protrusion 114, causes the latching rod 110 to navigate across the angled guiding surface 116. This series of steps may move the door 130 into a partially open position, thereby allowing a user to manually or automatically complete the opening of the door 130 so that the user may access the contents of the storage unit.

Figure 2B:
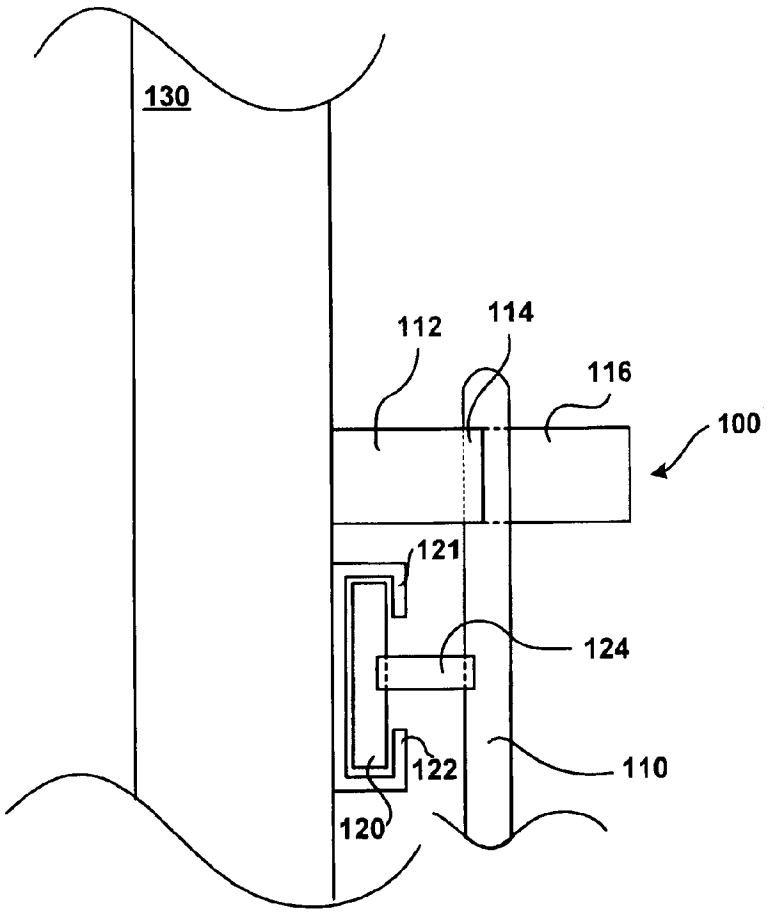
FIGS. 2*a* and 2*b* are side and top views for the device of FIG. 1 for opening a door in accordance with a preferred embodiment of the invention.
Figure 2A:
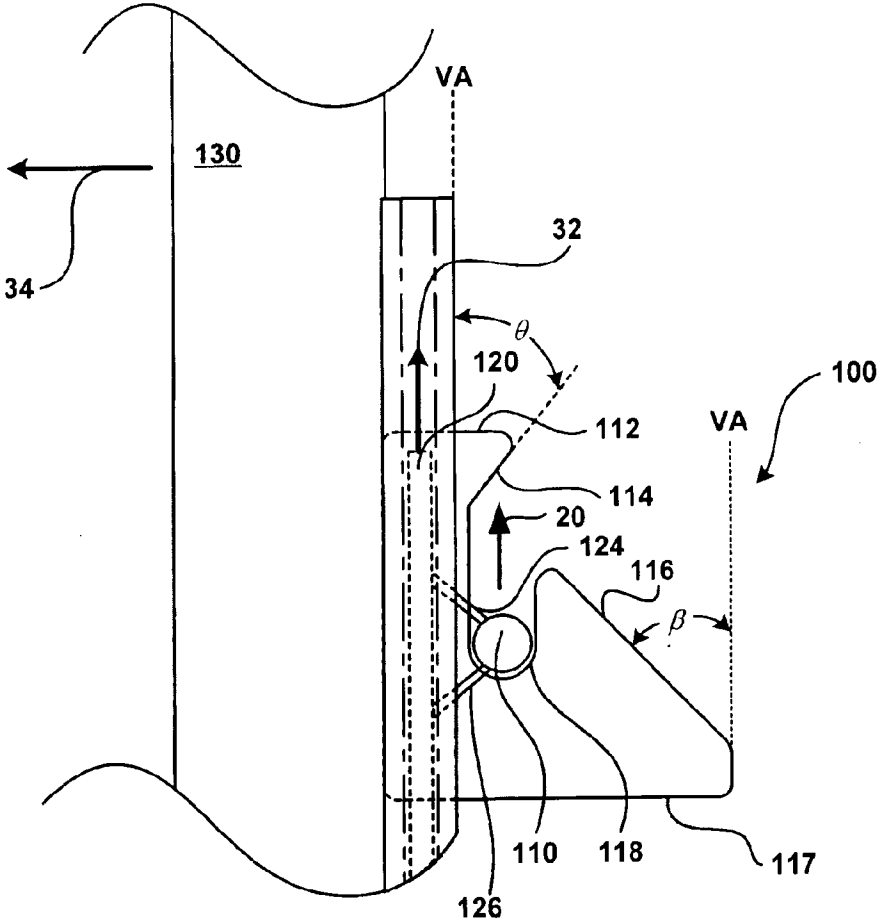

Referring now to FIGS. 2*a* and 2*b*, side and top views of the device for opening a door of FIG. 1 are described.

The base 117 of the receptacle structure 100 may be 4.3 inches long and the structure 100 may be 3.25 inches high. A vertical axis VA is perpendicular a base 117 of the structure 100 and the ground. The protrusion 114 forms an angle θ with a vertical axis VA. In one example, this angle is 30 degrees. The angled guiding surface 116 forms an angle β with the vertical axis VA. In one example, this angle is 57 degrees. Other values for both angles are possible.

In one example of the operation of the device of FIGS. 2*a* and 2*b*, the latching rod 110 and sliding assembly 120 may be coupled to a foot pedal, which is used to move the latching rod 110 upwards, when the foot pedal is pressed. One example of such an arrangement is described elsewhere in this specification. However, the latching rod 110 (and sliding assembly 120) may be coupled to any other mechanism that moves the latching rod 110 by any other action. For example, the mechanism may be manually lifted by a lever. Other examples are possible.

In one example of the operation of the device of FIGS. 2*a* and 2*b*, the latching rod 110 is moved upward, out of the receptacle 118 (in the direction of the arrow 20). In one example, and as described elsewhere in this specification, a foot pedal is used to lift the sliding assembly 120 (and hence, the latching rod 10) in the direction of arrow 32.

The latching rod 10 contacts the angled protrusion 114 of the top surface 112 and forces the assembly 100, and, therefore, the door 130 outward, as indicated by arrow 34. The movement of the door 130 and assembly 100 together with the contact of the latching rod 110 against the protrusion 114 may cause the latching rod 110 to navigate along the angled guiding surface 116 further pushing the door 130. This series of steps may move the door 130 into a partially open position, thereby allowing a user to manually or automatically complete the opening of the door 130 so that the user may access the contents of the storage unit.

Figure 3:
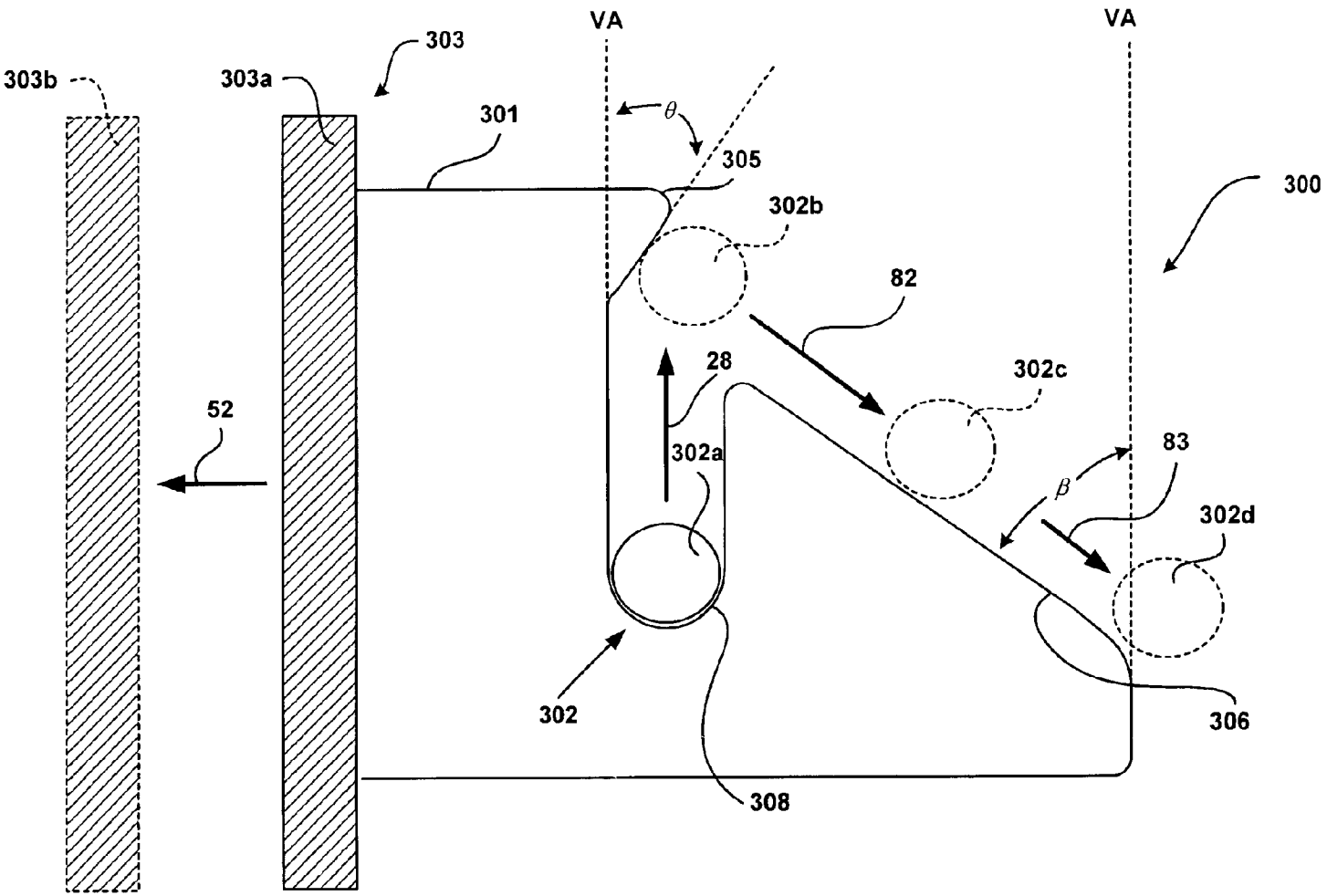
FIG. 3 is a side view showing the positions of a latching rod as it is moved to open a door in accordance with a preferred embodiment of the invention.

Referring now to FIG. 3, the movement of a latching rod 302 across a receptacle structure 300 is described. The receptacle structure 300 is attached to a door 303. The receptacle structure 300 includes a top surface 301 with an angled protrusion 305. A receptacle 308 is formed in the receptacle structure 300 between the top surface 301 and an angled guiding surface 306. The receptacle structure 300 may be secured to the door 303 via connectors (not shown). A vertical axis VA is perpendicular to the ground (not shown) and the top surface 301.

The protrusion 305 forms an angle θ with the vertical axis VA. In one example, this angle is 30 degrees. The angled guiding surface 306 forms an angle β with the vertical axis VA. In one example, this angle is 57 degrees. Other values for both angles are possible.

Initially, a latching rod 302 is in position 302*a*. The latching rod 302 is moved upward in the direction of arrow 28 until in comes into contact with the angled protrusion 305 and comes to position 302*b*. In one example, a foot pedal is used by a user to move the latching rod 302 upward.

The contact of the latching rod 302 with the angled protrusion 305 may force the door 303 (initially in position 303*a*) in the direction of arrow 52. After contacting the angled protrusion 305, the latching rod 302 may navigate the angled guiding surface 306 in the direction of arrow 82 coming to position 302*c*. Thereafter, the latching rod 302 may move in the direction of arrow 83 to position 302*d* and come to rest. The contact of the rod 302 with the guiding surface 306 may further push the door 303 to position 303*b*.

In other words, the combination of the contact of the latching rod 302 with the angled protrusion 305 and the navigation of the latching rod 302 along the angled guiding surface 306 may cause the door 303 to move in the direction of the arrow 52. The door 303 (along with the attached receptacle structure 300) may move in an outward direction until it comes to rest at position 303*b*. At this position, the door 303 may be partially opened and a user may move the door into a completely open position.

Figures 4A, 4B:
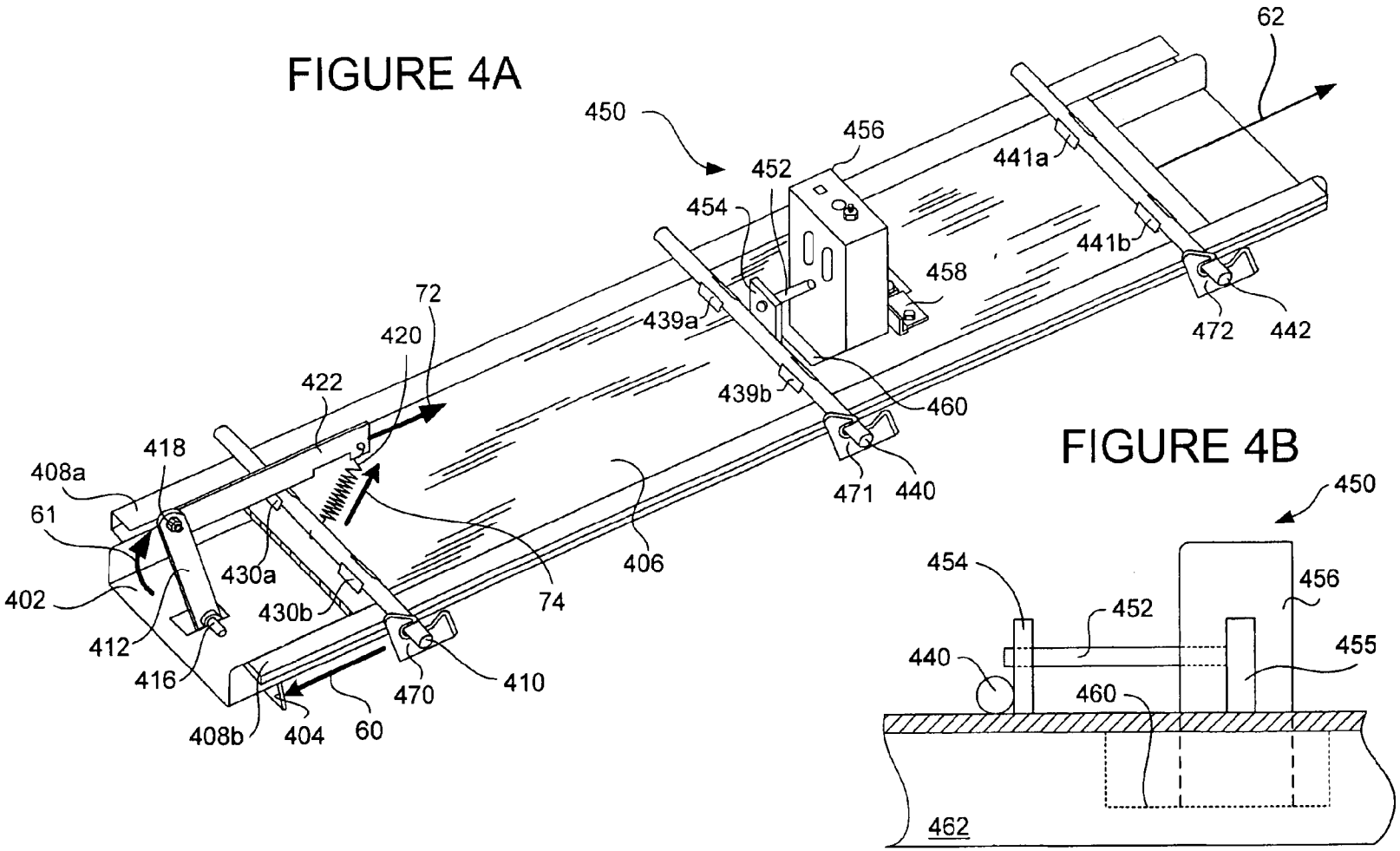
FIG. 4*a* is a perspective view of a system for opening a door including a foot pedal illustrated in accordance with a preferred embodiment of the invention.
FIG. 4*b* is a side view of a part of the system for opening a door including a foot pedal illustrated in FIG. 4*a* in accordance with a preferred embodiment of the invention.

Referring now to FIG. 4*a*, a system for opening a storage unit includes a body 402 (including grooved receptacles 408*a* and 408*b*), a foot pedal 404, a sliding assembly 406, a first latching rod 410, a lever arm 412, a connector 416, a connector 418, a spring 420, and a lever arm 422. The latching rod 410 may be coupled to the sliding assembly 406 by attachments 430*a* and 430*b*.

The device also includes a second latching rod 440, which is attached to the sliding assembly 406 via connectors 439*a* and 439*b*. A third latching rod 442 is attached to the sliding assembly 406 via connectors 441*a* and 441*b*. A locking mechanism 450 includes a rod 452, which is coupled to a plate 454. The plate 454 fits against the sliding assembly 406. The rod 452 is flush with the box 456. The latching rods 410, 440, and 442 may fit into receptacle structures 470, 471, and 472. The receptacle structures 470, 471, and 471 may be of the type described elsewhere in this specification.

The foot pedal 404 is coupled to the lever arm 412. The lever arm 412 is coupled to the lever arm 422. The lever arm 422 is coupled to the spring 420. The spring 420 is coupled to the latching rod 410.

The foot pedal 404 may be composed of industrial grade steel or any other suitable material. The foot pedal 404 may be, for example, welded to the lever arm 412. Alternatively, the foot pedal 404 and lever arm 412 may be a casting.

The latching rods 410, 440, and 442 may be composed of any suitable material, for example, industrial grade steel. In one example, the latching rods 410, 440, and 442 may be one-half inch in diameter and 9 and ⅜ inches long.

The lever arms 412 and 422 may be composed of any suitable material, for example, industrial grade steel. In one example, the lever arm 412 may be 6 inches long and the lever arm 422 may be 9 inches long.

The connector 416 may include a central rod, around which the lever arm 412 rotates. Appropriate fasteners, for example nuts, bolts, and washers may be used to secure the central rod to the lever arm 412.

The connector 418 may included a bolt and appropriate fastener. The connector 418 secures the first lever arm 412 to the second lever arm 422.

The spring 420 may be any type of appropriate spring. In one example, the spring 420 may be a steel spring 3.75 inches long, an initial tension of 9 pounds, a maximum deflection of 2.1 inches, and a total load at maximum deflection of 34 pounds. Alternatively, the spring 420 may be replaced with any stretching mechanism or member, for example, a rubber band. Other examples of stretching mechanisms are possible.

The locking mechanism 450 is locked, for example, when the rod 452 presses against the block 455. However, when the locking mechanism is unlocked, the block 455 may be removed or moved, allowing the rod 452 and plate 454 to move upward in the direction indicated by arrow 62. As this occurs, the sliding assembly 406, along with the latching rods 410, 440, and 442, may move upward as shown by the arrow 62.

In one example of the operation of FIG. 4*a*, the device is shown in an initial position. That is, the foot pedal 404 has not been pressed, and the sliding assembly 406, latching rods 410, 440, 442, lever arms 412 and 422, and the spring 420 remain in initial positions. Specifically, the latching rods 410, 440, and 442 remain in their respective receptacle structures 470, 471, and 472, and the spring 420 is in an unextended state. The sliding assembly 406 is in its bottom position within the grooved receptacles 408*a* and 408*b*.

The sliding assembly 406 (and hence the latching rods 410, 440, and 442) may be unlocked. For instance, a locking mechanism 450 may be unlocked so as not to prevent the sliding assembly 406 (and hence the latching rods 410, 440, and 442) from moving upward. In this case, the depression of the foot pedal 404 in the direction of arrow 60 may cause the lever arm 412 to rotate in a clockwise direction as shown by arrow 61 about the connector 416. The rotation of the lever arm 412 may cause the movement of the lever arm 422 in an upward direction (as indicated by is arrow 72). The movement of the lever arm 422 may move the spring 420 in the direction of arrow 74. The movement of the spring 420 may pull the latching rod 410 in the direction of the arrow 62.

The latching rod 410 may be pulled out of its receptacle structure 470. The pulling of the latching rod 410 may pull the sliding assembly 406 and latching rods 440 and 442 in a direction indicated by the arrow 62.

In another example of the operation, the sliding assembly 406 (and hence the latching rods 410, 440, and 442) have been locked. For instance, the locking mechanism 450 may prevent the sliding assembly 406 (and hence the latching rods 410, 440, and 442) from moving upward.

The depression of the foot pedal 404 in the direction of arrow 60 may cause the lever arm 412 to rotate in a clockwise direction indicated by the arrow 61 about the connector 416. The rotation of the lever arm 412 may cause the movement of the lever arm 422 in an upward direction (as indicated by the arrow 72). The movement of the lever arm 422 may stretch the spring 420 as indicated by the arrow 74. However, the stretching of the spring 420 does not move the latching rod 410.

In this case, the latching rod 410 remains in its receptacle structure 470. The force applied to the latching rod 410 does not move the sliding assembly 406. In this way, the latching rods 410, 440, and 442 are not moved from a latched position to an unlatched position.

The spring 420 may dissipate all or part of the energy of the downward movement of the foot pedal and subsequent movement of the lever arms. For example, if a sledgehammer would be applied to the foot pedal 404, the spring 420 may dissipate the energy and the latching rods 410, 440, and 442 would remain in latched positions. In other words, an intruder would not be able to gain entry into a storage unit by applying force to the foot pedal 404 to unlatch the latching rods 410, 440, and 442. The attempt to unlatch the latching rods 410, 440, and 442 would not damage the system.

It will be understood by those skilled in the art that the foot pedal arrangement described in FIG. 4*a* is only one example of an arrangement that can be used to move a latching rod. In another example, a lever could be used to manually lift the rods 410, 440, and 442. Other examples of lifting mechanisms are possible.

Referring now to FIG. 4*b*, the locking mechanism 450 shown in FIG. 4*a* is illustrated in a side view. The locking mechanism 450 includes the rod 452, which is coupled to the plate 454. The plate 454 is secured to the sliding assembly 406. The rod 452 is flush with the inside of the box 456. The box 456 extends into an opening 460 and the box 456 is secured in the opening 460. As shown, the locking mechanism 450 is locked and cannot move within the box 456 because the rod 452 is halted in its movement by the block 455. However, when the locking mechanism is unlocked, the to rod 452 can move within the box 456. The block 455 may be moved or removed using any convenient technique, for instance, by turning a key.

In view of the wide variety of embodiments to which the principles of the present invention can be applied, it should be understood that the illustrated embodiments are exemplary only, and should not be taken as limiting the scope of the present invention.

The claims should not be read as limited to the described order or elements unless stated to that effect. Therefore, all embodiments that come within the scope and spirit of the following claims and equivalents thereto are claimed as the invention.

What is claimed is:

1. A device comprising:

a receptacle structure, the receptacle structure coupled to a door, the receptacle structure having a top surface and an angled guiding surface, the top surface forming an angled protrusion, the receptacle structure having a receptacle, the receptacle formed between the top surface and the angled guiding surface;

a latching rod; and a sliding assembly coupled to the latching rod;

wherein upward movement of the sliding assembly causes the latching rod to move upwardly in said receptacle to contact the angled protrusion;

wherein the contact of the latching rod with the angled protrusion of the receptacle structure causes the rod to push the receptacle structure and the door to a partially open position;

wherein after the latching rod contacts the angled protrusion, the latching rod moves downwardly and slides along the angled guiding surface of the receptacle structure, thereby pushing the receptacle structure and the door to a further partially open position.

2. The device of claim 1 wherein the angled protrusion forms an angle of approximately 30 degrees with a vertical axis.

3. The device of claim 1 wherein the angled guiding surface forms an angle of approximately 57 degrees with a vertical axis.

4. A receptacle structure, the receptacle structure coupled to a door, the receptacle structure comprising:

a top surface and an angled guiding surface, the top surface forming an angled protrusion, the receptacle structure having a receptacle, the receptacle formed between the top surface and the angled guiding surface; and wherein a latching rod is positioned within the receptacle, and a sliding assembly causes the latching rod to move upwardly in the receptacle to contact the angled protrusion, and move upwardly in the receptacle to the contact of the latching rod with the angled protrusion of the receptacle structure causes the rod to push the receptacle structure and the door to a partially open position, and then the latching rod moves downwardly and slides along the angled guiding surface of the receptacle structure thereby pushing the receptacle structure and the door to a further partially open position.

5. The structure of claim 4 wherein the angled protrusion forms an angle of approximately 30 degrees with a vertical axis.

6. The structure of claim 4 wherein the angled guiding surface forms an angle of approximately 57 degrees with a vertical axis.

7. A method for opening a door comprising:

providing a receptacle structure having a top surface and an angled guiding surface, the top surface forming an angled protrusion, the receptacle structure having a receptacle, the receptacle formed between the top surface and the angled guiding surface;

positioning a latching rod within the receptacle;

moving the latching rod in an upward direction to contact the angled protrusion of, thereby causing the rod to push the receptacle structure and the door to a partially open position; and navigating the latching rod downwardly across the angled guiding surface of the receptacle structure, thereby pushing the receptacle structure and the door to a further partially open position.

8. A storage device comprising:

a door;

a receptacle structure, the receptacle structure coupled to the door, the receptacle structure having a top surface and an angled guiding surface, the top surface forming an angled protrusion, the receptacle structure having a receptacle, the receptacle formed between the top surface and the angled guiding surface;

a latching rod; and a sliding assembly coupled to the latching rod;

upward wherein movement of the sliding assembly causes the latching rod to move upwardly in said receptacle to contact the angled protrusion; and wherein the contact of the latching rod with the angled protrusion of the receptacle structure causes the rod to push the receptacle structure and the door to a partially open position, and then the latching rod moves downwardly and slides along the angled guiding surface of the receptacle structure, thereby pushing the receptacle structure and the door to a further partially open position.

9. The storage device of claim 8 wherein the angled protrusion forms an angle of approximately 30 degrees with a vertical axis.

10. The storage device of claim 8 wherein the angled guiding surface forms an angle of approximately 57 degrees with a vertical axis.

11. The storage device of claim 8 wherein the sliding assembly is coupled to a foot pedal.

* * * * *